United States Patent [19]

ChaBakKuk

[11] 4,037,354

[45] July 26, 1977

[54] EDUCATIONAL AND TOPOLOGICAL TOYS, PACKAGING, KEY, JEWEL, FLOATING GEAR, ARCHITECTURE AND GEODESICS, SPACE MECHANICS AND VISUAL EYE THERAPY DEVICES

[76] Inventor: ChaBakKuk, New Brighton, Beaver County, Pa. 15066

[21] Appl. No.: 552,643

[22] Filed: Feb. 24, 1975

[51] Int. Cl.[2] ..... A63H 33/06

[52] U.S. Cl. ..... 46/1 L

[58] Field of Search ..... 46/1 L, 1 R, 11; 229/8, 229/16 R

[56] References Cited

U.S. PATENT DOCUMENTS 3,730,818 5/1973 Salinari ..... 46/1 L

FOREIGN PATENT DOCUMENTS 588,842 6/1947 United Kingdom ..... 46/1 L

OTHER PUBLICATIONS

Descriptive Mineralogy, by Edward Salisbury Dana, pp. 84–86, published by John Wiley & Sons, 1906.

Cardboard Modeling, by William Heaton, p. 158, published by O. Newmann & Co., 1894.

*Primary Examiner*—Louis G. Mancene

*Assistant Examiner*—Robert F. Cutting

*Attorney, Agent, or Firm*—Buell, Blenko & Ziesenheim

[57] ABSTRACT

A toy, packaging, key, jewel, floating gear and architectural geodesic device is provided in the form of a three dimensional package whose outer surfaces are defined by wrapping a flat sheet cut selectively from an even number of connected conical and triangular segments into a closed package with all edges in contact with another edge of the sheet.

6 Claims, 24 Drawing Figures

Fig. 1.
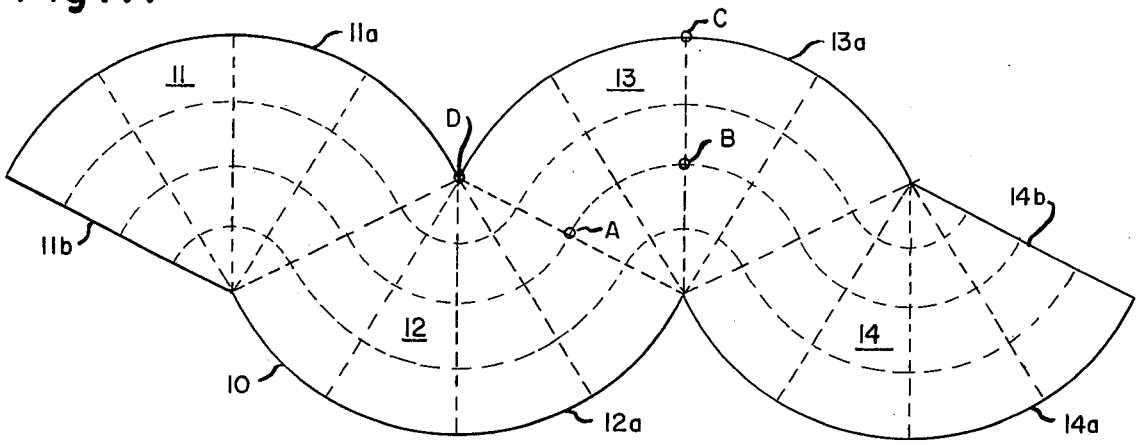
Fig. 2.
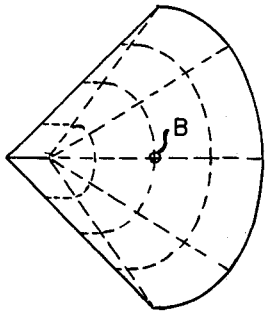
Fig. 3.
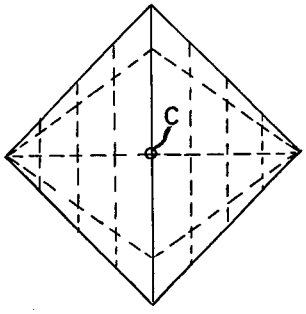
Fig. 4.
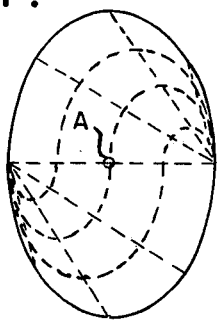
Fig. 5.
Fig. 6.
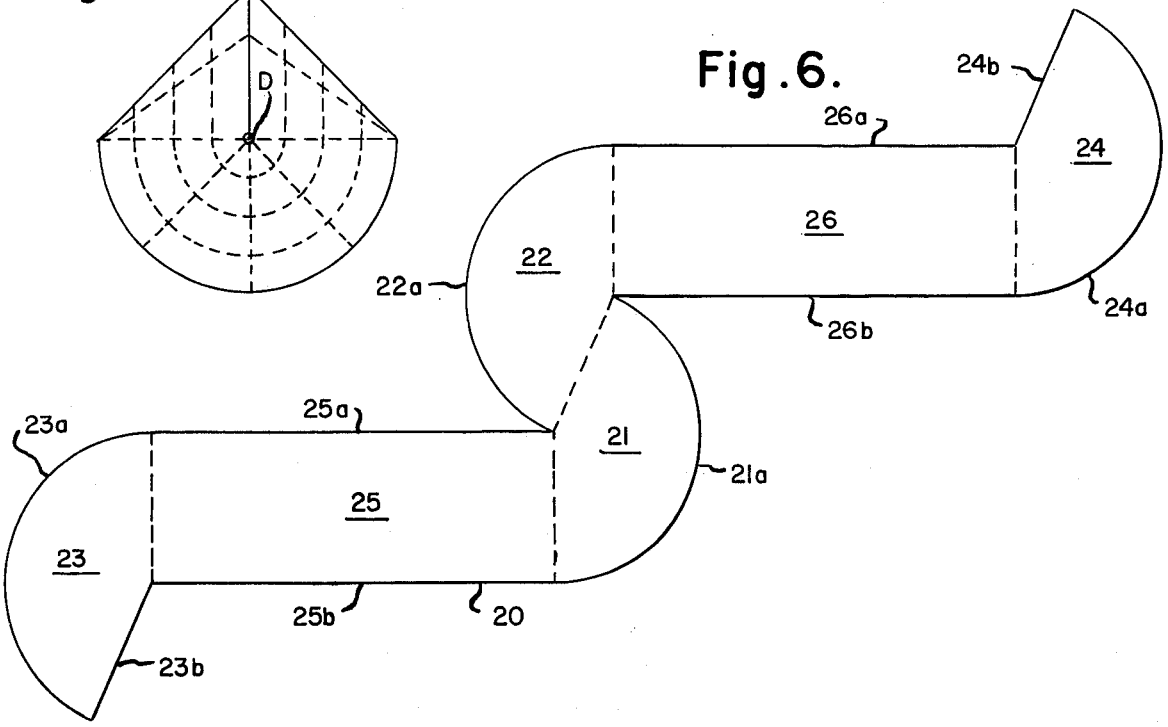

21
21a, 26b
22
22a, 25a
24a, 25b
25
23
23a, 26a
26
31
31a
32
32a
33
33a
33b
34
34a
34b
35
35a
35b
36
36a
36b
37
37a
37b
38
38a
38b

EDUCATIONAL AND TOPOLOGICAL TOYS, PACKAGING, KEY, JEWEL, FLOATING GEAR, ARCHITECTURE AND GEODESICS, SPACE MECHANICS AND VISUAL EYE THERAPY DEVICES

This invention relates to toys, packaging, architecture geodesic, space mechanics and visual eye therapy devices. There are many situations where a non-circular three dimensional device having a constant level center of gravity is desired. Such a device can be used as a toy, a packaging container, an architectural geodesic device and the like. As a toy the device rolls along an S-shaped curve without change in the height of its center of gravity. As a package it can be formed from a single sheet without buckling or deforming. It can be used in the architecture of domes and shells in which a spiral of spirals of constant width are desired rather than conventional spherical truncations or the traditional use of concentric circles.

The device of this invention comprises selectively an even number of conical segments of one kind, mixed conical segments of two kinds and conical segments mixed with an even number of cylindrical segments. The choice of segments used provides a variety of different structures. Preferably I use a single sheet having an equal number of conical segments of one kind wrapped to a closed container. Such a formed package will roll along an S-curve without change in height of its center of gravity. It forms an interesting and unique toy and as such could be cast in plastic with a mold formed as herein described.

In the foregoing general description I have set out certain objects, purposes and advantages of my invention. Other objects, purposes and advantages will be apparent from a consideration of the following description and the accompanying drawings in which:

FIG. 1 is a plan view of a flat sheet cut on the outline of four half right circular cones in which the radius equals the height;

FIGS. 2–5 are elevational views from different angles of the package formed by wrapping the sheet of FIG. 1 into a closed package;

FIG. 6 is a plan view of a flat sheet cut on the outline of two adjacent half right circular cones connected to two spaced apart half circular cones by two identical cylindrical sections on each side of said two half circular cones;

Figures 7, 8, 9, 10, 11, 12, 13:
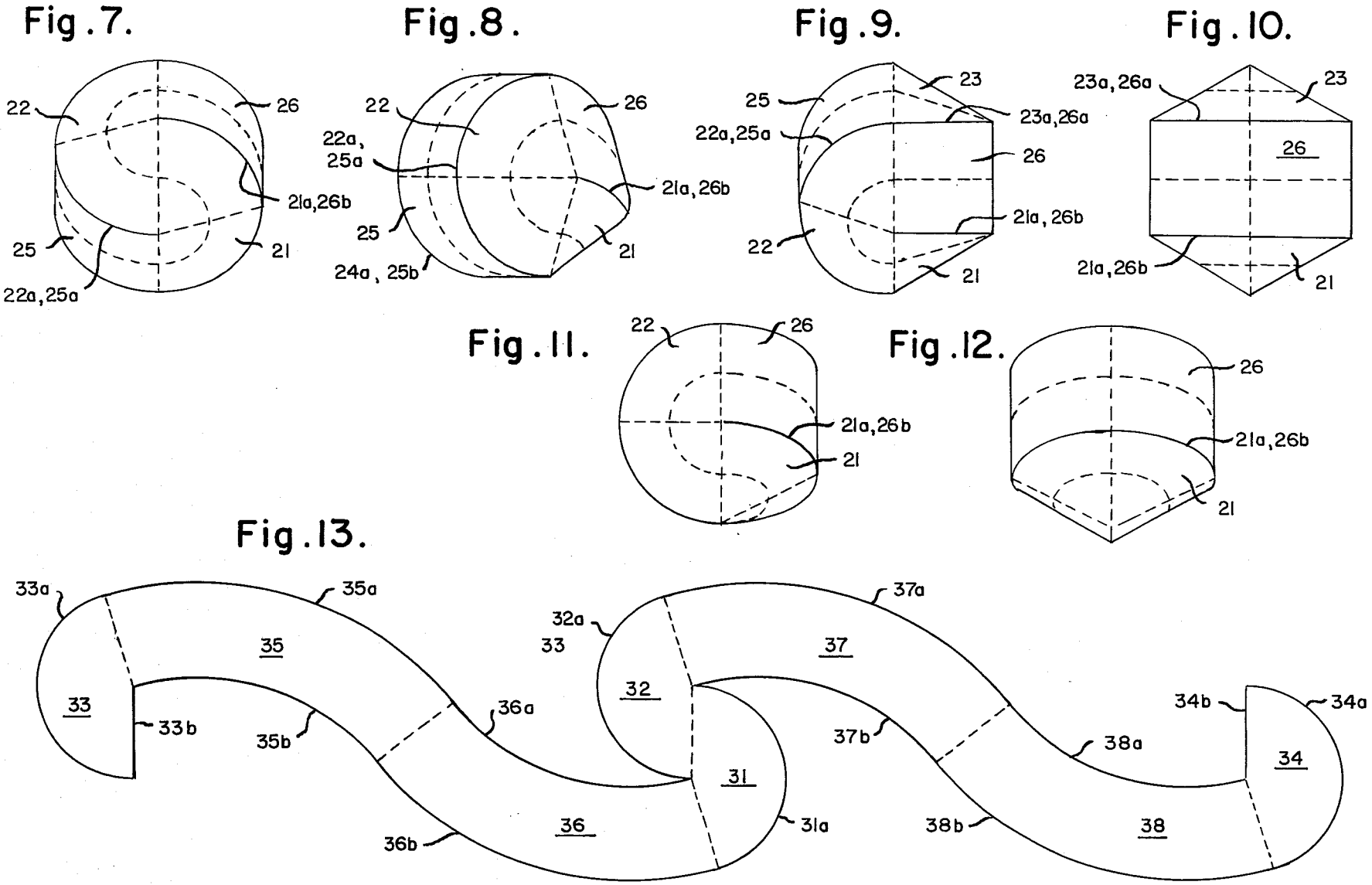
FIGS. 7–12 are elevational views from six different angles of the package formed by wrapping the sheet of FIG. 6 into a closed package.
FIG. 13 is a plan view of a flat sheet cut on the outline of two adjacent half right circular cones connected to two spaced apart half circular cones by two identical but oppositely directed conical sections on each side of said two half circular cones.
Figure 14:
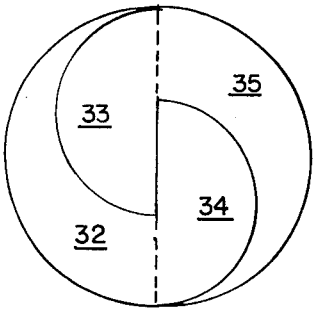
FIGS. 14–16 are elevational views from three different angles of the package formed by wrapping the sheet of FIG. 6 into a closed package.
Figure 15:
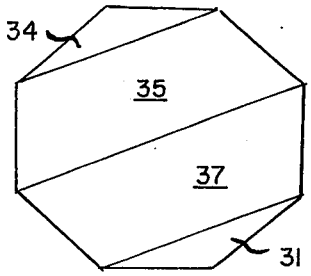
Figure 16:
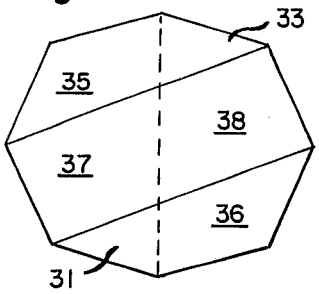
Figure 17:
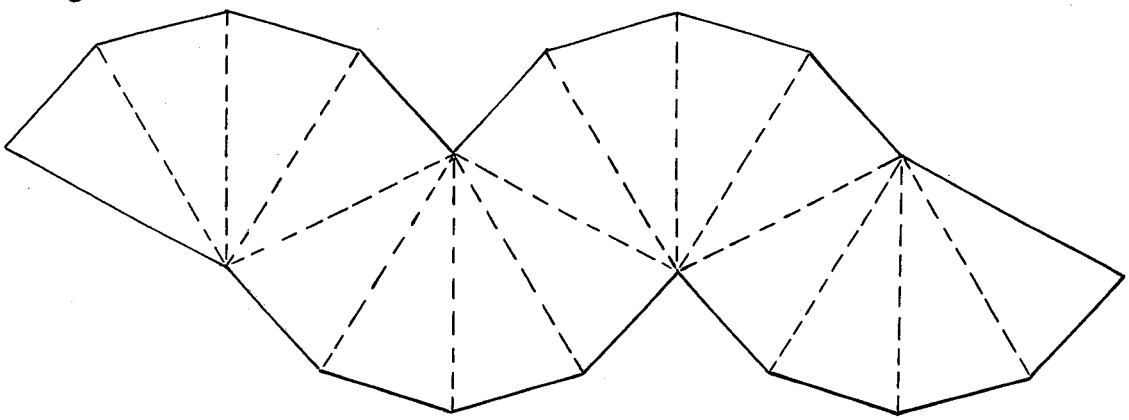
FIG. 17 is a plan view of a sheet cut on the outline of 20 adjacent identical isosceles triangular segments.
Figure 18:
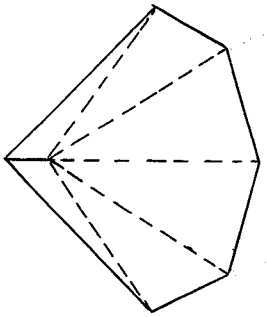
FIGS. 18–21 are elevational views from four different angles of the package formed by wrapping the sheet of FIG. 17.
Figure 19:
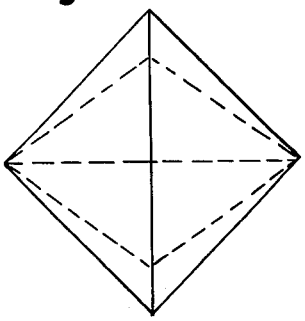
Figure 20:
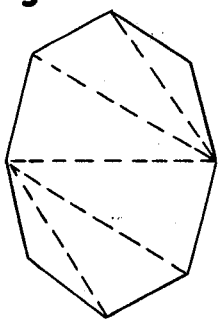
Figure 21:
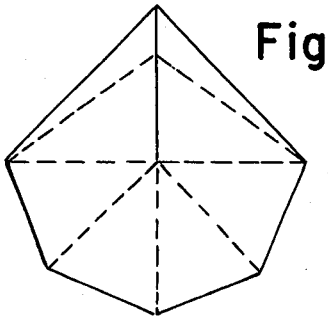

Referring to the drawings I have illustrated a sheet 10 cut in the form of four successive oppositely directed half right circular cones 11, 12, 13 and 14 whose radius equals the height. The sheet is wrapped on itself to form a closed package with the arcuate periphery 11*a* of segment 11 contacting the arcuate periphery 13*a* of segment 13; the arcuate periphery 12*a* of segment 12 contacting the arcuate periphery 14*a* of segment 14 and the edge 11*b* of segment 11 engaging the edge 14*b* of segment 14. The resulting closed package will have the appearance illustrated in FIGS. 2–5. The package will roll along an S-curve with a constant height center of gravity, filled or unfilled.

The package formed from sheet 10 may be used as a mold and filled or used as a blow mold for forming a plastic or other material into a toy having the configuration of the package. Such a toy is a fascinating device for a child since it rolls in an S-curve path with an ease comparable to that of a ball rolling. The side-to-side motion however is unique and enthralling to children as well as adults.

In FIG. 6 I have illustrated a sheet 20 cut to outline two adjacent intermediate half right circular cones 21 and 22 and two spaced half right circular cones 23 and 24 having identical diameters and heights. The half right circular cones 21 and 23 are connected by a cylindrical segment 25 and the half right circular cones 22 and 24 are connected by a like identical cylindrical segment 26. The sheet 20 is wrapped on itself with the edge 25*a* of cylindrical segment 25 engaging arcuate periphery 22*a* of conical segment 22; arcuate periphery 23*a* of conical segment 23 engaging edge 26*a* of cylindrical segment 26; edge 23*b* of segment 23 and edge 24*b* of segment 24 in engagement; edge 25*b* of cylindrical segment 25 engaging arcuate periphery 24*a* of conical segment 24; and edge 21*a* of conical segment 21 engaging edge 26*b* of cylindrical segment 26. The resulting closed package will have the appearance illustrated in FIGS. 7 through 12 as taken from different angles. The package will roll along a sinuous curve with a constantly level center of gravity. As in he case of FIG. 1 package, the package of FIGS. 6–12 can be used as a toy, as a container, as an architectural structure or in any of a variety of other ways. It may be used as a mold for forming a solid or blow molded plastic toy or container.

In FIG. 13 I have illustrated a third embodiment of my invention formed from a strip 30 cut to outline two adjacent intermediate half right circular cones 31 and 32 and two spaced right circular cones 33 and 34 having identical diameters and heights. The half right circular cones 31 and 33 are connected by two adjacent but oppositely directed truncated conical segments 35 and 36 and the half right circular cones 32 and 34 are connected by truncated conical segments 37 and 38 identical with 35 and 36. The sheet 30 is wrapped upon itself to form a closed figure with edges 32*a* and 36*a* in contact; edges 35*a* and 37*a* in contact; edges 33*a* and 38*a* in contact; edges 34*b* and 33*b* in contact; edges 31*a* and 37*b* in contact; edges 38*b* and 36*b* in contact; and edges 34*a* and 35*b* in contact. This forms a closed package which, like those of FIGS. 1–12, will roll with a serpentine or sinuous path with a constant level center of gravity. Like the packages of FIGS. 1–12 it can be used for packaging, as a toy or as an architectural element.

FIGS. 17–21 are similar to the article of FIGS. 1–5 using an isosceles triangle as the base rather than conical segments.

Figure 22:
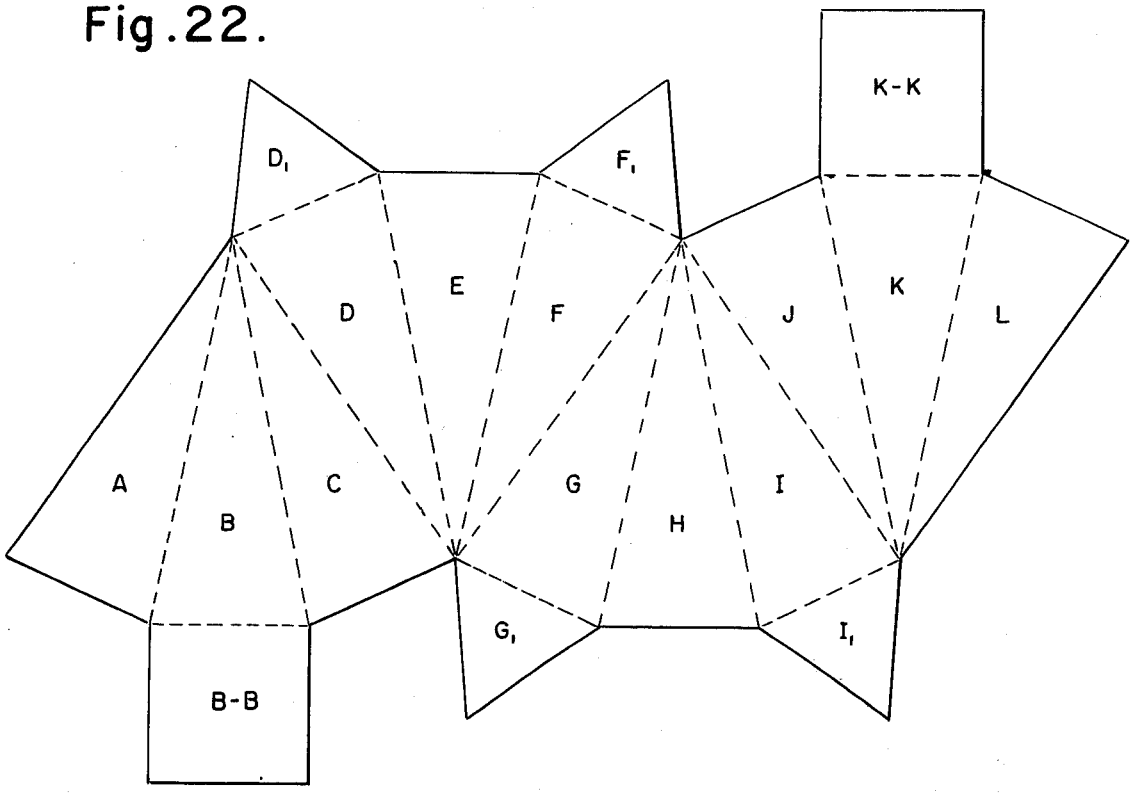
FIG. 22 is a plan view of a sheet cut on the outline of twelve isosceles triangles, four equilateral triangles and two approximate squares to product a similar product.
Figure 23:
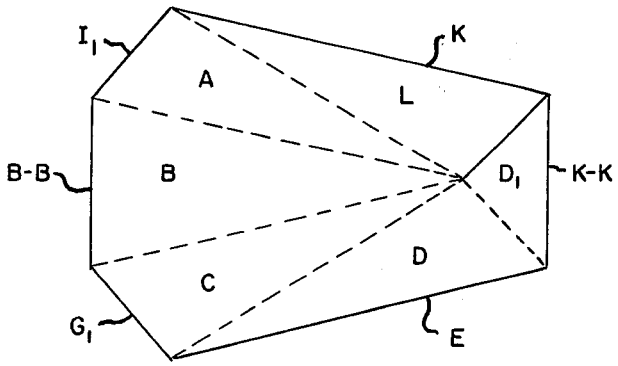
FIGS. 23–24 are elevational views from 2 different angles of the article formed from the sheet of FIG. 22.
Figure 24:
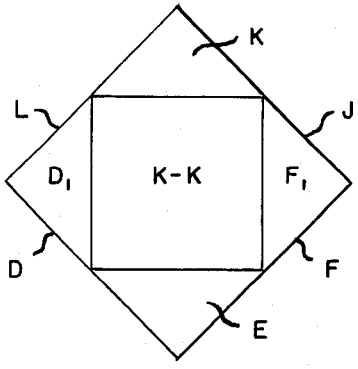

FIGS. 22–24 are another article based upon the uses of connected isosceles triangles.

All of these figures have a constant center of gravity and roll along an S-curve.

While I have illustrated and described certain preferred embodiments of my invention in the foregoing specification it will be understood that this invention will be otherwise embodied within the scope of the following claims.

I claim:

1. A toy, packaging, key, jewel, floating gear and architectural geodesic device having a constant center of gravity and at least one continuous substantially curvilinear surface comprising a three dimensional package whose outer surfaces are defined by wrapping a flat sheet cut selectively from an even number of connected arcuate segments of one kind formed into conical segments, mixed arcuate segments of two kinds formed into conical segments, arcuate segments of one kind formed into conical segments mixed with an even number of rectangular segments formed into cylindrical segments into a closed package with all edges in contact with another edge of the sheet.

2. A toy, packaging, key, jewel, floating gear and architectural geodesic device as claimed in claim 1 wherein the flat sheet is formed from four half right circular cones.

3. A toy, packaging, key, jewel, floating gear, and architectural geodesic device as claimed in claim 1 wherein the flat sheet is formed from two adjacent intermediate half right circular cones and two spaced apart half right circular cones with the intermediate conical segments connected to the spaced conical segments by a cylindrical segment.

4. A toy, packaging, key, jewel, floating gear and architectural geodesic device as claimed in claim 1 wherein the flat sheet is formed from two adjacent intermediate half right circular cones and two spaced apart half right circular cones with the intermediate conical segments connected to the spaced conical segments by two pairs of frusto conical segments in which the segments of each pair be in opposite directions.

5. A toy as claimed in claim 1 formed in rigid plastic.

6. A toy as claimed in claim 2 formed of rigid plastic.

* * * * *

UNITED STATES PATENT OFFICE

CERTIFICATE OF CORRECTION

Patent No. 4,037,354 Dated July 26, 1977

Inventor(s) Cha Bak Kuk

It is certified that error appears in the above-identified patent and that said Letters Patent are hereby corrected as shown below:

Column 1, line 18, "of" second occurrence, should read --or--.

Column 2, line 46, "he" should read --the--.

Column 4, claim 5, line 23, "in" second occurrence, should read --of--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*